US006381792B1

(12) United States Patent
Woodfin

(10) Patent No.: US 6,381,792 B1
(45) Date of Patent: May 7, 2002

(54) MODULAR FOAM FLOATING BRIDGE

(75) Inventor: Ronald L. Woodfin, Sandia Park, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/443,028

(22) Filed: Nov. 18, 1999

(51) Int. Cl.[7] ..... E01D 15/14
(52) U.S. Cl. ..... 14/2.6; 14/27
(58) Field of Search ..... 14/2.4, 2.6, 27; 409/39, 41; 114/266, 267

(56) References Cited

U.S. PATENT DOCUMENTS

| | | | | | |
|---|---|---|---|---|---|
| 1,583,638 | A | * | 5/1926 | Zadigian | 14/2.6 |
| 4,318,361 | A | * | 3/1982 | Sluys | 114/263 |
| 4,487,151 | A | * | 12/1984 | Deiana | 114/266 |
| 4,488,833 | A | * | 12/1984 | Perry et al. | 404/35 |
| 4,493,284 | A | * | 1/1985 | Echtler | 114/267 |
| 4,754,723 | A | * | 7/1988 | Ghering | 114/353 |
| 4,809,636 | A | * | 3/1989 | Robishaw et al. | 114/267 |
| 5,107,785 | A | * | 4/1992 | Baxter | 114/266 |
| 5,183,001 | A | | 2/1993 | Stranzinger | |
| 5,870,964 | A | * | 2/1999 | Gerber et al. | 114/263 |
| 5,911,542 | A | * | 6/1999 | Obrock et al. | 405/219 |
| 6,000,358 | A | * | 12/1999 | Dickenson | 114/344 |
| 6,021,730 | A | * | 2/2000 | Carey, II | 114/263 |

OTHER PUBLICATIONS

Woodfin, et al., "Results of Experiments on Rigid Polyurethane Foam (RPF) for Protection from Mines," Sandia Report SAND98–0645C, Feb. 1998.
Woodfin, "Rigid Polyurethane Foam (RPF) Technology for Countermine (Sea) Program Phase 1," Sandia Report SAND96–2841, Jan. 1997.
Woodfin, "Countermines, Unexploded Ordnance and Explosive Detection—Rigid Polyurethane Foams for Countermining," Sandia Report SAND97–1053C, May 1997.

* cited by examiner

*Primary Examiner*—Gary S. Hartmann
(74) *Attorney, Agent, or Firm*—George H. Libman

(57) ABSTRACT

A floating modular bridge has a plurality of modules of two types. Most modules are flexible fabric envelopes having a parallelogram profile that attains shape and strength when filled on site with a rigid foam that is injected into the envelope. The other module is a keystone that has a trapazoidal profile. These modules are strung together by cables to make a lightweight bridge.

13 Claims, 2 Drawing Sheets

MODULAR FOAM FLOATING BRIDGE

CROSS REFERENCE TO RELATED APPLICATIONS (Not Applicable)

The United States Government has rights in this invention pursuant to Department of Energy Contract No. DE-AC04-94AL85000 with Sandia Corporation.

BACKGROUND OF THE INVENTION

This invention relates to a bridge for crossing a body of water. More particularly, it relates to a modular bridge that may be easily transported to a site and assembled.

A bridge is a conventional structure utilized to place a pathway across a body of water. If the pathway has sufficient strength to support a load, then this load may be transported via the pathway over the body of water. If a bridge is over a body of water at a particular location is needed quickly, either because an existing bridge has been rendered unusable by either natural disasters (such as flood or earthquake) or the ravages of mankind (war or accident), or because events (such as troop movement during war) require a body of water to be crossed where no bridge has existed, then temporary bridges are typically used.

Floating bridges have been suggested for such applications. R. Woodfin et al., "Results of Experiments on Rigid Polyurethane Foam (RPF) for Protection from Mines, Sandia National Laboratories report SAND98-0645C, Feb. 1998, teaches that prefabricated barges may be constructed using nylon fabric for exterior and internal compartment walls which are filled with RPF on-site to form a durable, low-draft barge that is easily transported to a body of water. U.S. Pat. No. 5,183,001 of M. Stranzinger teaches that floats can be assembled to form platforms and bridges.

SUMMARY OF THE INVENTION

It is an object of this invention to provide a floatable module that may be strung together with other modules to form a floating bridge.

It is another object of the invention to provide a floatable module that is filled with expandable foam on-site.

It is a further object of this invention to provide a modular floatable bridge that may be easily transported to a site and erected.

To achieve the foregoing and other objects, the present invention may comprise an outer envelope having a top and bottom pieces, each defining a relatively planar surface having spaced parallel ends and spaced sides with the sides being longer than the ends, the top and bottom surfaces being parallel to and spaced from each other. Each of these pieces is also symmetrical along a center line extending between the ends, and centered over each other. A first end piece extends from a first end of the top piece to a first end of the bottom piece, and a second end piece extends from a second end of the top piece to a second end of the bottom piece. Each of the end pieces extends at an angle other than a right angle from each of the surfaces. A pair of spaced side pieces complete the envelope, and at least the side pieces are made of supple sheet material. A tubular cable run extends between the end pieces for pieces for enabling a plurality of modules to be strung together.

Additional objects, advantages, and novel features of the invention will become apparent to those skilled in the art upon examination of the following description or may be learned by practice of the invention. The objects and advantages of the invention may be realized and attained as particularly pointed out in the appended claims.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION OF THE INVENTION

Figure 1:
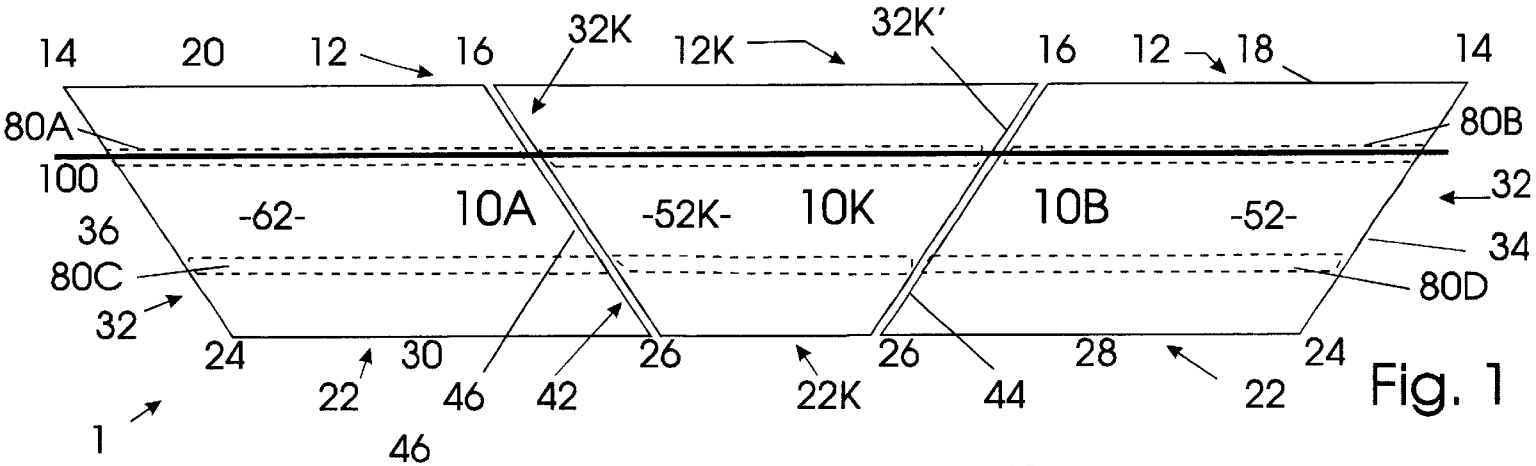
FIG. 1 shows a side view of three modules fastened as a bridge.

FIG. 1 shows a section of a floating bridge 1 in accordance with an embodiment of this invention to include three modules, 10A, 10K, and 10B. (Modules 10A and 10B are identical to each other, but viewed from opposite sides in the Figure.) As discussed hereinafter, these modules nest together along a cable 100 to form a bridge 1 for spanning a body of water, with the ends of cable 100 being fastened to land on either end of the bridge 1.

The modules 10 at each end of FIG. 1 are identical in construction, but are utilized facing in opposing directions. Each of these modules has an outer envelope surrounding a volume that is filled with expandable foam 90, as discussed hereinafter. Each envelope has opposed first and second horizontal substantially planar surfaces 12 and 22 of equal length, spaced substantially planar end pieces 32 and 42, and spaced side pieces 52 and 62 having the outline of a parallelogram, with each module 10 having the form of a parallelepiped. Module 10K differs from module 10 in that its opposed horizontal surfaces 12K and 22K are of different lengths, and with spaced side piece 52K and an opposite side that is not shown form the outline of a trapezoid. The edges of each of these pieces are fastened to the edges of the adjoining pieces to form the envelope shaped as a prism with a trapzoidal cross-section.

First and second horizontal relatively planar surfaces 12 and 22 are referred to as 'horizontal' because they are horizontal when a module 10 floats with surface 22 slightly below the surface of the body of water. They are referred to as 'relatively planar' because they are kept relatively flat so that surface 12 may function as a bridge path and surface 22 will float in a stable position. Since the envelope attains its shape by being filled with an expanding foam, without shape restraint the envelope would seek the shape of a sphere. A surface that approaches spherical in either longitudinal or cross-section would be unsatisfactory both as an upper surface (where the curve would make it difficult for traffic) and as a bottom surface (where the curve. would make it unstable as a float). Accordingly, means are provided for keeping these surfaces relatively planar. These means may be internal ties, stays, webs or the like which are structural members of fixed length that extend from one interior surface to an opposing interior surface, or reinforcing plates. Such plates may be placed in pockets on either the interior or exterior of the surface, or they may be merely held against the exterior while the foam is expanded.

Figure 4:
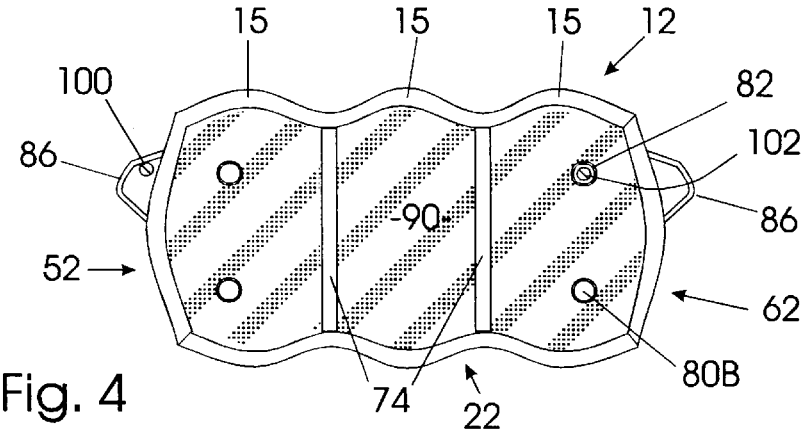
FIG. 4 shows a cross sectional view of the module of the invention.
Figure 5:
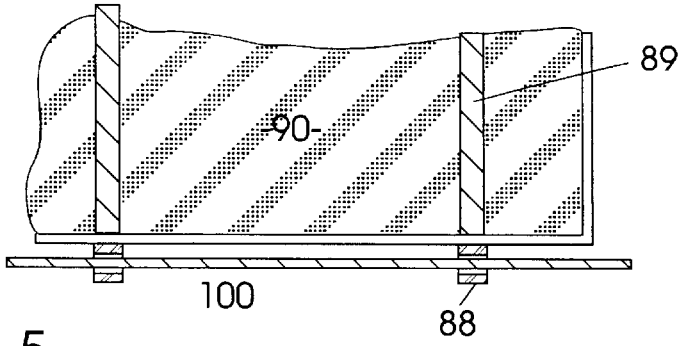
FIG. 5 shows another embodiment of a cable run of the invention.

As shown in FIG. 4, a relatively planar surface 12 may have a series of ridges 15 between spaced ties 74, but the resulting surface 12 is flat enough to sustain vehicle or foot traffic.

As shown in FIG. 1, each surface 12 has straight end edges (14, 16 and 24, 26) and side edges 18, 20 and 28, 30. The side edges of the horizontal surfaces are preferably straight and parallel, and the end edges are perpendicular to a center plane 5, but such construction is not required. In addition, while the side and end edges of each horizontal surface are preferably of equal width, they may be unequal. However, to ensure stability as a floatation device, each horizontal surface 12 and 22 (and 12K and 22K) is symmetrical about vertical center reference plane 5.

Figure 2:
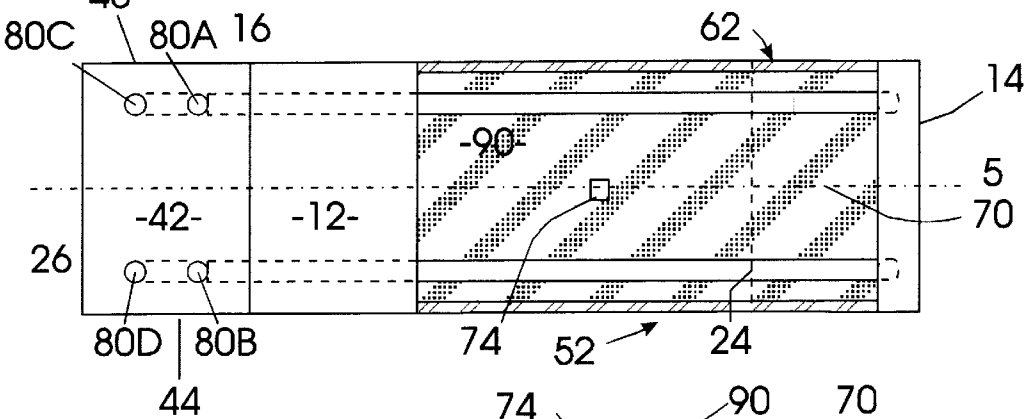
FIG. 2 shows a top cut-away view of a module of the invention.
Figure 3:
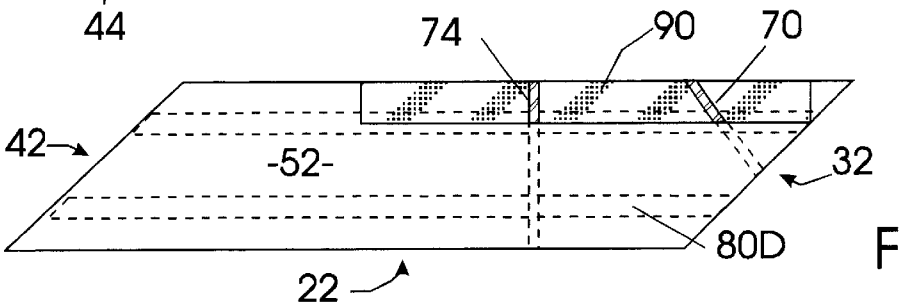
FIG. 3 shows a side view of the cut-away module of FIG. 2.

The end pieces 32, 42 of module 10 preferably define a relatively planar surface to enable adjoining the ends of adjoining modules to overlap as shown in FIG. 1. The upper and lower edges of upper end piece 32 are defined by and fastened to end edges 14 and 24 of the horizontal surfaces. The upper and lower edges of lower end piece 42 are defined by and fastened to end edges 16 and 26 of the horizontal surfaces. The sides 44, 46 of end piece 42 are seen in FIG. 2; side 34 of end piece 32 is seen in FIG. 1, side 36 is seen in module 10A in FIG. 1.

The plane of each end piece 32, 42 or 32K, 32K' does not intersect the plane of the horizontal surfaces at a right angle. Having an acute angle on the order of 30° to 60° serves two purposes. The lower surface 22 of each module 10 floats on the surface of the body of water and the upper surface 12 serves as a path for traffic. In use, the banks of the body of water will be sloped to fit upper end piece 32 of module 10, while lower end piece 42 is sloped to fit under either upper end piece 32K, 32K' of module 10K.

The angled end pieces 32, 42, 32K, 32K' serve several purposes. They are utilized in keystone module 10K to change the direction of slope so that each end 32 of the modules on the ends of the bridge 1 fits a respective bank. In addition, where end piece 42 of one module abuts end piece 32 of the adjoining module 10, or end pieces 32K and 32K' of module 10K there is no gap between modules along the path as there would be if the end pieces were perpendicular to the horizontal surfaces. The angled module contacts also permit some flexibility to be maintained between the modules by adjusting the tension in the cables. Lastly, because keystone module 10K functions as a wedge, it ensures that the bridge modules may be tightly held against each other.

The side piece 52 of module 10 (or 52K of module 10K) extends between side edges 18, 28 of the horizontal surfaces 12, 22 and side edges 34, 44 of end pieces 32, 42. Opposing side piece 62 extends between side edges 20 and 30 of the horizontal surfaces and side edges 36, 46 of the end pieces.

The envelope of this invention may be constructed of any supple material that is inelastic in the sense that it does not distort significantly when the envelope is inflated by foam. Any heavy fabric or other material that does not degrade when subjected to expanding foam, such as material used for tents or awnings, is suitable for this application. The upper surface 12 may also be formed of different fabrics, or additional thicknesses of fabric, to provide better wear performance as a roadway.

As shown in FIGS. 2—5, each module 10 is filled with a rigid polyurethane foam (RPF) 90, a material that may be shipped to a location for use in component form. When the components are mixed, a liquid foam is formed that quickly fills module 10 and hardens into a rigid foam 90. Such foams typically expand from 10 to 60 times the as-shipped volume of their components, which means that the fabric of module 10 may be folded flat for storage and shipment. Alternatively, a rigid epoxy foam or other rigid polymer foam which is non-toxic, expands to fill a volume, and hardens after expansion, may be employed as the fill material 90.

As shown in FIG. 4, the sides 52, 62 of module 10 may bow a little under the pressure of the expanded foam. However, the parallel relationship between the horizontal surfaces 12 and 22 is maintained as discussed above by a series of internal webs (not shown) or ties 74 that extend on the inside of the envelope between these surfaces. Such restraining structure also is utilized to maintain the relatively planar surface of the end pieces, as shown by ties 70 in FIG. 3.

Each module 10 includes at least one, and preferably at least four, cable runs 80 extending the length of the module. The illustrated embodiment includes four parallel runs, 80A, 80B, 80C, 80D arranged as the comers of a rectangle centered about center plane 5. In one embodiment, each run is formed by placing a rigid pipe 82 within the empty envelope before the envelope is filled with foam. Pipe 82 is preferably constructed from polyvinylchloride (PVC) because RPF adheres to it very well, and PVC is strong enough to withstand the pressure of the expanding foam. Each pipe 82 may be retained in the proper location during module assembly by properly spaced fittings in end pieces 32, 42 and in webs 70. Alternatively, the location of each pipe may be marked on the exterior of end pieces 32, 42, and holes cut on-site for the pipe when it is determined which runs are to be used in each module.

To assemble a module 10, the envelope is carried to a location to be bridged and unfolded. If necessary, holes are cut in pieces 32, 42 through which pipes 82 are placed. The envelope is then stretched out along the pipes and suspended by the pipes and by upper surface 12 or 22 from any available structure. Foam is then injected into the envelope, causing it to fill and stretch to shape. Foam also surrounds each pipe 82, ensuring that it will not move from module 10. Any foam that leaks out the holes adjacent pipes 82, and the ends of pipe 82 which extend outside module 10, are cut off, and the module is ready for use.

The modules may be assembled into a bridge as shown in FIG. 1. Modules 10 are strung along cables 100, 102 which pass through runs 80. The spacing of the runs is selected so that runs in each module 10 are aligned with runs of adjacent modules 10 or 10K. To string the modules, the cables are fastened to a tree, a buried weight or 'deadman', or other immovable object on one side of the body of water and pulled to the other side. The modules are assembled, threaded onto the cables, and pushed into the body of water towards the other side. The first module is arranged so end piece 32 faces the far bank. A keystone module 10K will be placed in the string near the middle of the body of water, and the remaining modules strung with end piece 32 facing the opposite bank. Once the modules are in place, vehicles, draft animals, or a winch are used to pull the cables tight and wedge the modules in place against the banks.

Figure 6:
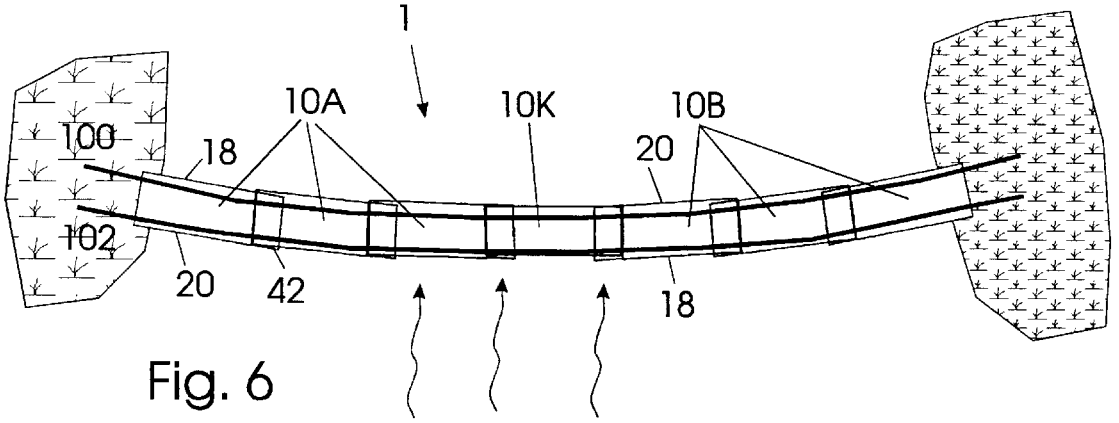
FIG. 6 shows an embodiment of the invention for high current applications.

If the current is too swift for two cables, additional cable runs and cables may be utilized. In addition, while horizontal surface 12 normally has sides edges 18, 20 of equal length, for applications where bridge 1 is expected to curve because of length and current, module 10 may be constructed with side edges 18 and 28 a little shorter that opposing sides 20 and 30 for modules 10A at one bank, and with side edges 20 and 30 a little shorter than edges 18 and 28 for modules 10B at the other bank. As a result, end piece 42 will intersect plane 5 at an angle other than 90°, as shown in FIG. 6, where the current flows up in the figure. (Each end piece is shown in gray in FIG. 6 and is understood to be under overhanging end piece 32 of the adjoining module.) This structure enables the curved bridge 1 to maintain a tight fit as it crosses the body of water, and reduces the tension on the cables.

Other embodiments of this invention are also contemplated. As also shown in FIG. 4, for low weight traffic applications, such as foot traffic, the cables 100, 102 may be retained by fabric sleeves 86 attached to the outer surface of module 10. Alternatively, the cable runs may consist of a plurality of spaced eyelets 88 extending from the sides of module 10. These eyelets could screw onto a rod 89 that is passed through module 10 prior to insertion of the foam in the same manner as pipes 82. However, because these rods extend across the width, rather than the length, of module 10, they would be easier to pack and carry. These alternative embodiments do not need pipe 82 in each cable run.

Since an unloaded span will float with a draft of only 10% of its thickness, the drag caused by the current is less than with floating bridges of deeper draft. The 90% freeboard Also provides a large buoyancy margin to prevent capsizing under eccentric loading.

A principal advantage of the invention lies in its favorable transport characteristics. The expansion characteristics of the foam reduces the volume of the bridge materials to about $1/25^{th}$ of the volume of the finished bridge. Accordingly, the materials may be transported to a site much more easily than other bridges. A bridge to cross a 50 meter river should require only one trained person for the step of filling the envelope with RFP, and about four unskilled laborers.

The concept is sufficiently flexible for the design of foot bridges a meter wide and a foot deep and vehicle bridges as large as 10 meters wide and a meter deep. The module envelopes may be fabricated using standard sewing techniques employed by upholsterers, sailmakers, or awning manufacturers, with the seams on the outside for ease of construction. Necessary tools for installation include mixing apparatus for the RFP, digging tools, and cable tensioning equipment.

The following table provides an approximation of the size and cost of materials for a 116 foot long bridge of four modules, each 28 feet long by 10 feet wide and 2.5 feet thick, using RPF of finished density 4 pounds per cubic foot.

| Element | Per pontoon | Total Bridge |
|---|---|---|
| River Width at Crossing | | 112 ft |
| Traffic Lanes | | 1 |
| Maximum Live Load Capacity (Roadway Awash) | 40,000 lbs | 50,000 lbs |
| RPF Materials Weight (Excluding Containers) | 3000 lbs | 12,000 lbs |
| Envelope Weight (Including Fairleads) | 88 lbs | 360 lbs |
| Cable Weight | N/A | 434 lbs |
| Total Finished Weight | 3,100 lbs | 12,800 lbs |
| Draft, Dead Load Only | 2.25 in | 2.5 in |
| Draft, Dead Load Plus 20,000 lbs Live Load | 16 in | 6 in |
| Shipping Volume, Envelope | 1 cu ft | 4.4 cu ft |
| Shipping Volume, RPF Chemicals (In 55 gal Drums) | 6 drums | 24 drums |
| Weight, RPF Dispenser & Associated Equipment | 200 lbs | 200 lbs |
| Shipping Volume RPF Dispenser & Associated Equipment | 48 cu ft | 48 cu ft |
| Weight, Basic Tool Set | 75 lbs | 75 lbs |
| Shipping Volume, Basic Tool Set | 16 cu ft | 16 cu ft |
| Estimated Completed Cost (materials only) | $4,000 | $17,000 |

The particular sizes and equipment discussed above are cited merely to illustrate a particular embodiment of this invention. It is contemplated that the use of the invention may involve components having different sizes and shapes as long as the principles disclosed herein are followed. It is intended that the scope of the invention be defined by the claims appended hereto.

What is claimed is:

1. A floating bridge comprising a plurality of parallelogram modules and one trapazoid module arranged in an end-to-end series relation along at least one cable extending from a first rigid support at one end of said bridge to a second rigid support at the other end of said bridge, all said modules comprising:

an outer envelope consisting of opposed and equal rectangular end pieces, opposed and equal side pieces, and opposed and equal rectangular surface pieces, the edges of said pieces being connected to each other to form a six-sided structure enclosing a volume, the volume being filled with rigid polymer foam;

said parallelogram modules having side pieces having the shape of a parallelogram wherein one of the angles between end pieces and surface pieces is acute and the other angle is obtuse;

said trapazoid module having side pieces having the shape of a trapezoid wherein the angles between the end pieces and the surface pieces are equal to the angles of the parallelogram modules;

wherein said modules are arranged such that an upper end piece from each module overlaps a lower end piece from an adjacent module.

2. The floating bridge of claim 1 wherein said envelope for each module includes an opening for filling said outer envelope with said foam.

3. The floating bridge of claim 1 wherein for each module, the external pieces and surfaces of said outer envelope are formed from supple inelastic sheet material.

4. The floating bridge of claim 3 further comprising a flexible and inelastic internal restraint fastened between pieces of each module.

5. The floating bridge of claim 4 wherein said restraint is a flexible tie connecting an end piece and an adjacent horizontal surface.

6. The floating bridge of claim 1 wherein for each module, said cable passes through a cable run comprising a straight tubular passage extending inside said envelope between said opposed end pieces.

7. The module of claim 6 wherein said passage is a rigid pipe embedded in said polymer foam.

8. The floating bridge of claim 6 wherein there are four parallel passages extending through each module, the ends of said passages defining a rectangle in each end piece, each rectangle being centered on said end piece; and said at least one cable comprises a cable extending through each passage.

9. The floating bridge of claim 8 wherein each passage is a rigid pipe embedded in said rigid polymer foam.

10. The floating bridge of claim 1 wherein said at least one cable extends through at least one passage fastened to the outside of each side piece.

11. The floating bridge of claim 10 wherein said at least one passage comprises a flexible sleeve.

12. The floating bridge of claim 1 wherein said bridge extends from a first embankment to a second embankment, and an upper end piece of each module adjacent a shore overlaps an embankment.

13. The floating bridge of claim 1 wherein said acute angles are between 30° and 60°.

* * * * *